US005803453A

United States Patent [19]

Stephan et al.

[11] Patent Number: 5,803,453

[45] Date of Patent: Sep. 8, 1998

[54] GAMING MACHINE LIGHT HANDLE AND ASSOCIATED CIRCUITRY

[75] Inventors: Don C. Stephan, Carson City; Roy E. Adams; David W. Loar, both of Reno, all of Nev.

[73] Assignee: International Game Technology, Reno, Nev.

[21] Appl. No.: 846,959

[22] Filed: Apr. 29, 1997

[51] Int. Cl.[6] ..... A63F 9/24

[52] U.S. Cl. ..... 273/138.2; 463/20; 463/37; 273/143 R

[58] Field of Search ..... 273/138.2, 143 R; 250/221; 463/37, 20

[56] References Cited

U.S. PATENT DOCUMENTS

| | | | |
|---|---|---|---|
| 3,816,745 | 6/1974 | Primm et al. | 250/221 |
| 4,939,358 | 7/1990 | Herman et al. | 250/221 |
| 5,168,173 | 12/1992 | Windsor | 307/139 |
| 5,212,391 | 5/1993 | Wachli | 250/561 |
| 5,451,770 | 9/1995 | Stewart | 250/221 |
| 5,511,784 | 4/1996 | Furry et al. | 273/143 R |
| 5,536,934 | 7/1996 | Hayashi | 250/214.1 |

*Primary Examiner*—Jessica Harrison
*Assistant Examiner*—Alison Kessler
*Attorney, Agent, or Firm*—Beyer & Weaver, LLP; Al Penilla

[57] ABSTRACT

Disclosed is a method and apparatus for activating a gaming machine. The invention includes generating a visible light column at a light generating end when the gaming machine is in a ready state. The invention further includes receiving the visible light column at an a light intensity determining circuit. The light intensity determining circuit being configured to monitor disturbances along the visible light column. Then, activating the gaming machine when the light intensity received at the light intensity circuit moves beyond a predetermined level while in the ready state.

34 Claims, 4 Drawing Sheets

GAMING MACHINE LIGHT HANDLE AND ASSOCIATED CIRCUITRY

BACKGROUND OF THE INVENTION

1. Field of the Invention

The present invention relates generally to gaming technology, and more particularly to gaming machine handles and associated actuating circuitry.

2. Description of the Related Art

As is well known, the gaming industry uses many types of games to entertain players. As an incentive for playing the games, players generally wager sums of money with the expectation of winning a jackpot. To ensure that players remain interested in the games of their choice, casinos typically provide a festive atmosphere that includes attractive lighting, music and complementary beverages. Generally, many casinos rely heavily on traditional games such as the slot machine to entertain large numbers of players because slot machines require relatively less operating overhead.

Traditional slot machines include spinning reels that may be activated in a number of ways which include mechanical pull-down handles and electrical activation buttons. When a player approaches the slot machine and inputs a credit to initiate a play, the machine may have a small light to indicate to the player that it is ready to be activated. At this point, the player may rotate the mechanical pull-down handle or push a play button to activate the rotation of the reels. Once activated, the reels will spin and thereafter come to rest. If the final resting point of the reels indicate that the user has won, the slot machine will either deliver the coin winnings to the user or provide the player with one or more credits of play.

Because the basic operation and attraction of slot machines has substantially remained the same over time, there has been an effort to add features to slot machines that maintain the flow of play, yet make the machines more interesting and easy to use. For example, bill validators that accept currency are now a regular feature on new machines. However, to date, slot machines have generally lacked the electronic gadgetry that attracts a younger generation of players.

Sometimes, to increase the level of attraction, casinos have decorated slot machines with thematic images, some of which are taken from popular television programs and movies. While such decorations provide some margin of additional attraction, they represent but a minor change in the overall appearance of slot machines and do not change the machine's basic operation or structure. Some casinos have added gaming machines with arcade-type sounds to their gaming floors in hopes of increasing the entertainment level of the machines. Unfortunately, the vast majority of slot machine users seem to have little interest in such features.

In view of the foregoing, there is a need for gaming machine features that increase the level of entertainment while maintaining the flow of play.

SUMMARY OF THE INVENTION

Broadly speaking, the present invention increases the level of entertainment of slot machine play by providing a slot machine light handle that serves to activate a slot machine when a player passes an object through the light handle. By passing the object (e.g., a player's hand) through the light handle, the player causes a disturbance in light between a light transmitter and a light receiver which causes associated electronic circuitry to spin the slot machine's reels. It should be appreciated that the present invention can be implemented as either a method, or an apparatus. Several inventive embodiments of the present invention are described below.

In one embodiment, a gaming machine actuation device is disclosed. The actuation device includes a transmitter for emitting light for indicating an active state of the gaming machine. A lensing system emits a light source from the transmitter that produces a light column that is output as a concentrated light beam which may or may not be visible to the player. A receiver for receiving the concentrated light beam output from the lensing system, is configured to produce a first voltage level when the gaming machine is in the active state. A decision circuit accepts the first voltage level from the receiver, and a second voltage level from a variable voltage generator. When the light column is interrupted, the first voltage level moves beyond the second voltage level to produce a first pulse. The actuation device further includes a signal conditioner configured to receive the first pulse, and variably widen the first pulse to produce a second pulse that actuates the gaming machine.

In another embodiment, a method for activating a gaming machine is disclosed. The method includes generating a light source from a light generator when the gaming machine is in a ready state. The light source may or may not be visible to the player. In either case, the light source emits a column of light. The method further includes receiving the light source at a light intensity determining circuit at the end of the light column. The light intensity determining circuit is configured to monitor disturbances along the light column. Then, activating the gaming machine when the light intensity received at the light intensity circuit moves beyond a predetermined level while in the ready state.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE PREFERRED EMBODIMENTS

A gaming device light handle for activating a gaming device is disclosed. To activate the gaming device, a player may pass an object through a light column attached to the gaming device which causes a disturbance in light between a transmitter and a receiver. In the following description, numerous specific details are set forth in order to provide a thorough understanding of the present invention. It will be understood, however, to one skilled in the art, that the present invention may be practiced without limitation to some or all of these specific details. In other instances, well known process operations have not been described in detail in order not to unnecessarily obscure the present invention.

For purposes of simplicity, this specification will refer to a slot machine. It should be understood that the term slot machine is intended to mean a gaming device which may have spinning reels or a video output for use with a poker game or other wagering games, such as Keno, blackjack, etc. Games of these types are known in the art and are typically manufactured by IGT of Reno, Nev.

Figure 1A:
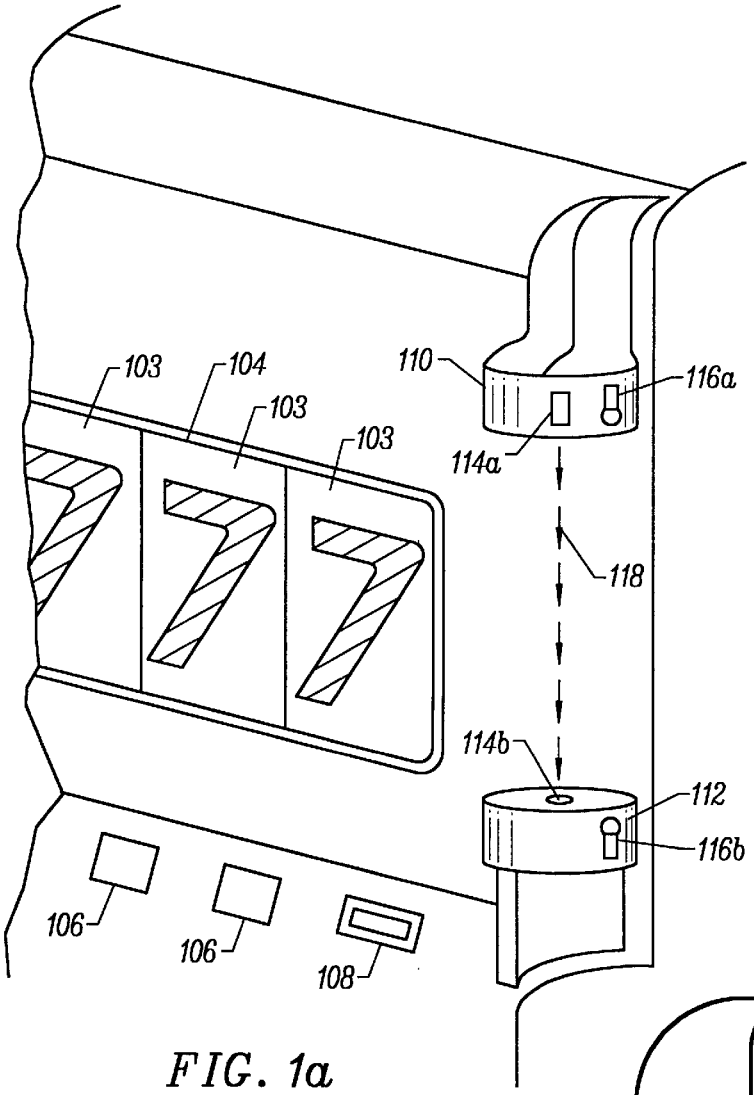
FIG. 1A is a partial view of a slot machine having a light handle in accordance with one embodiment of the present invention.

FIG. 1A is a partial view of a slot machine 102 having a light handle in accordance with one embodiment of the present invention. As shown, slot machine 102 includes reels 103 that are displaying a number "7" behind a glass window 104. As is well known in the art, traditional activation buttons 106 may include a spin reel button, a max bet button, a bet one credit button, a change button, and a cash out button.

A coin receptacle 108 is generally provided on slot machine 102 for receiving coins (i.e., credits) to activate the machine. Although only coin receptacle 108 is shown for ease of description, other methods for activating slot machine 102 may be used. By way of example, slot machine 102 may be activated by paper money, debit cards, credit cards or the like. Once activated, slot machine 102 is ready for the user to initiate the spinning of reels 103. In this embodiment, a light handle including a transmitter unit 110, and a receiver unit 112 is used to initiate the spinning of reels 103.

Preferably, transmitter unit 110 and receiver unit 112 are constructed of translucent plastic containing white incandescent light bulbs 116*a* and 116*b*. In this manner, once the player activates slot machine 102 by inserting an appropriate credit, transmitter unit 110 and receiver unit 112 light up in an entertainingly glowing fashion. Once the white incandescent light bulbs 116*a* and 116*b* light up transmitter unit 110 and receiver unit 112, the player becomes aware that slot machine 102 is ready for play. In addition to the entertaining glowing effect, a light emitter 114*a* contained within transmit unit 110 directs a light column 118 at a light receiver 114*b* contained within receiver unit 112. In one embodiment, light column 118 that is emitted from light emitter 114*a* may be a "red" laser looking beam that advantageously attracts a players attention.

At this point, transmitter unit 110 and receiver unit 112 are glowing and light column 118 is active and ready for the player to initiate the spinning of reels 113. When a player passes an object (e.g., a hand) through light column 118, reels 113 begin spinning as in traditional mechanical handle activation systems. In this embodiment, when an object is passed through light column 118, the light emitted from light emitter 114*a* is disrupted enabling light receiver 114*b* to detect the disturbance in light column 118. The detected disturbance is then processed through an electrical circuit that preferably causes reels 113 to spin.

Figure 1B:
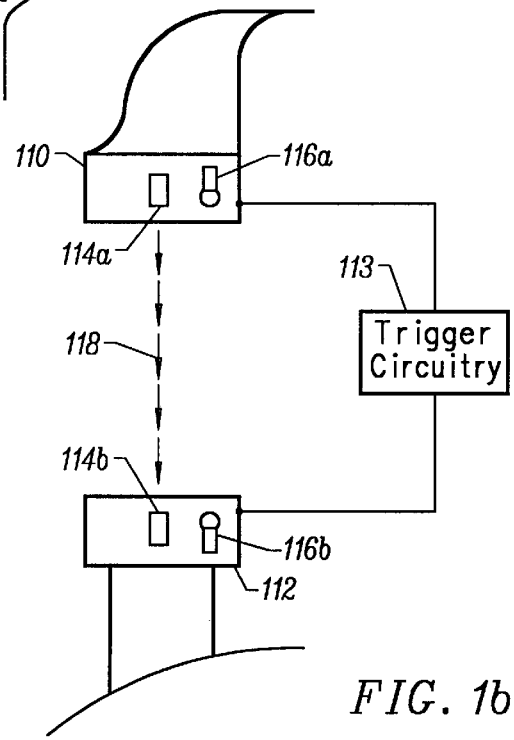
FIG. 1B is a more detailed diagram of a light handle having a transmitter unit and a receiver unit connected to suitable trigger circuitry in accordance with one embodiment of the present invention.

FIG. 1B is a more detailed diagram of a light handle having transmitter unit 110 and receiver unit 112 connected to trigger circuitry 113 in accordance with one embodiment of the present invention. As described above, when light column 118 is disrupted, the disruption will be detected by light receiver 114*b* which produces a voltage level variation detected by trigger circuitry 113. Trigger circuitry 113 then provides a switching signal that causes slot machine 102 to spin reels 103 as shown in FIG. 1A.

Figure 2:
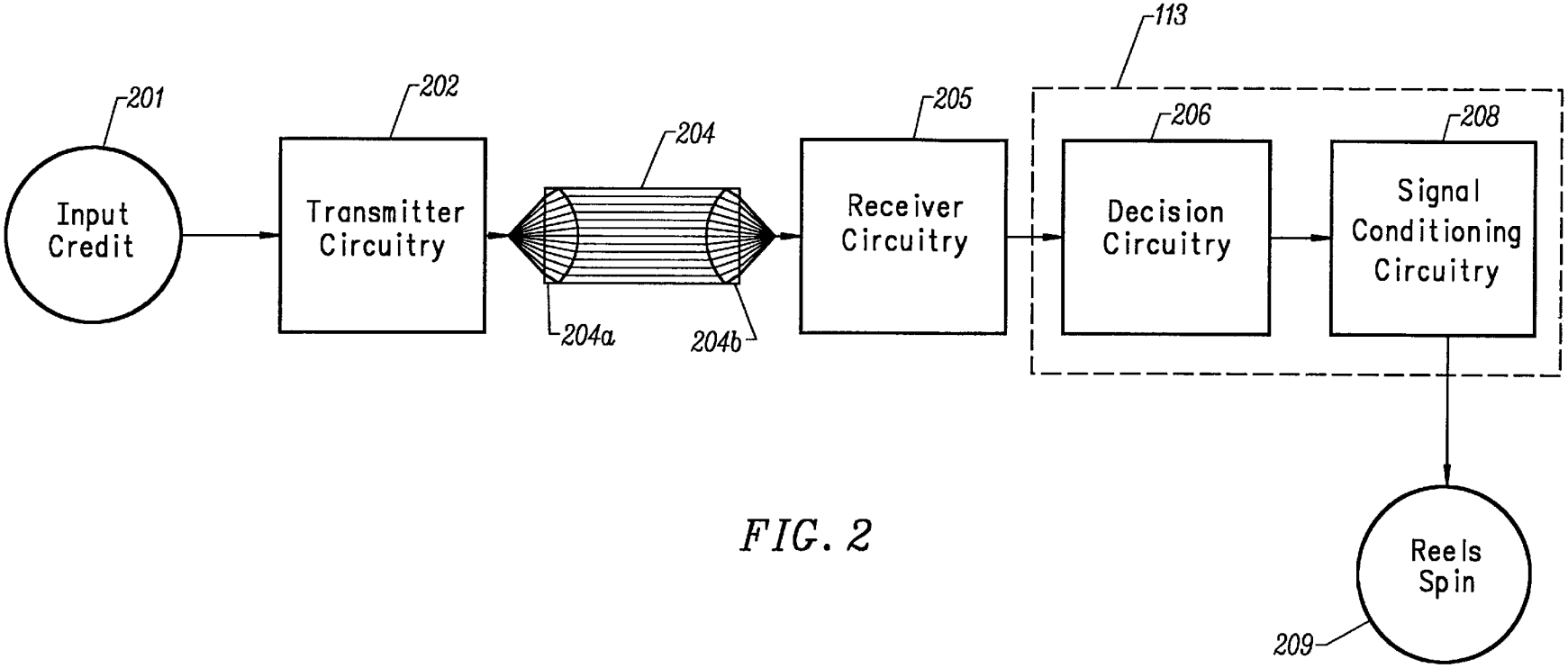
FIG. 2 is a functional block diagram representing preferred circuitry for initiating the play of a gaming device in accordance with one embodiment of the present invention.

FIG. 2 is a functional block diagram representing preferred circuitry for initiating the spinning of reels 103 in slot machine 102 in accordance with one embodiment of the present invention. Initially, the associated circuitry is powered-up when a player inputs a credit that causes transmitter unit 110 and receiver unit 112 to glow and the activation of light column 118. By way of example, the associated circuitry is provided with suitable biasing voltages that maintain the light handle ON and ready to receive a disturbance.

Once the player inputs a credit 201, transmitter circuitry 202 powers up to produce a light beam that is directed at a planar convex lens 204*a* of a lens system 204. Once the light is directed at planar convex lens 204*a,* the received light is columnated (i.e., aligned into a plurality of parallel light beams) and directed at a second opposite facing planar convex lens 204*b*. Preferably, planar convex lens 204*b* is aligned with planar convex lens 204*a* so that the intensity o f the light beam is substantially constant along a distance defined between the lenses. Once planar convex lens 204*b* receives the columnated light from convex lens 204*a,* the light is directed at receiver circuitry 205. Although any suitable lensing system may be used, the planar convex lenses may be obtained from Edmund Scientific Company of Berrington, N.J.

In an alternative embodiment, a laser system may be employed within transmitter circuitry 202 to eliminate the need for lensing system 204. As can be appreciated, laser light is generally less susceptible, to disruption by ambient conditions and may be more accurately directed at receiver circuitry 205 without the aid of lensing system 204. Once receiver circuitry 205 receives light column 118 from lensing system 204, the receiver circuitry produces an active voltage level that is passed to decision circuitry 206 contained within trigger circuitry 113 of FIG. 1B.

In general, decision circuitry 206 is configured to detect a change in the active voltage level received from receiver circuitry 205. By way of example, when the active voltage level moves beyond a predetermined voltage level, indicative of the player passing an object through the light beam, decision circuitry 206 will produce a trigger signal that is passed to single conditioning circuitry 208. Signal conditioning circuitry 208 is particularly suited to generate a pulse having a predetermined pulse width that is used to initiate the spinning of reels 209 in accordance with one embodiment of the present invention.

Figure 3:
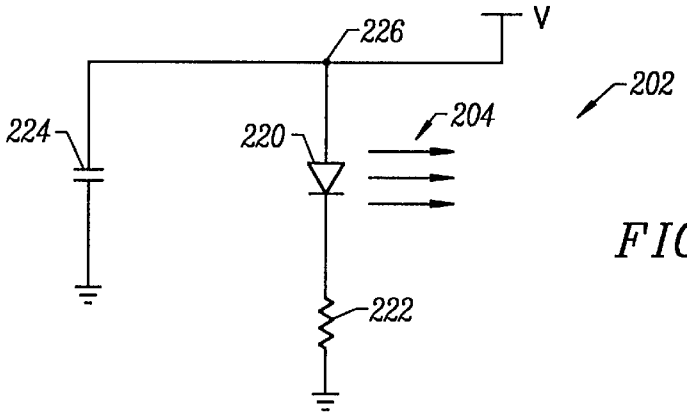
FIG. 3 shows preferred transmitter circuitry in accordance with one embodiment of the present invention.

FIG. 3 shows preferred transmitter circuitry 202 in accordance with one embodiment of the present invention. In this embodiment, a voltage level suitable for biasing transmitter circuitry 202 is preferably applied to a node 226 when slot machine 102 becomes active (e.g., when a player inputs a credit). Although any suitable voltage level may be applied at node 226, the preferred voltage level is about 5 volts that is passed to a light-emitting diode 220. Also shown is a decoupling capacitor 224 that is used to filter noise and prevent fluctuations in the light being emitted by light-emitting diode 220. In an alternative embodiment, where a more compact circuit arrangement is desired, decoupling capacitor 224 may be omitted.

Further included is a current limiting resistor 222 that functions to limit a current drain to ground and enables light-emitting diode 220 to output a sufficient level of light that is preferably directed at lensing system 204 as shown in FIG. 2. In this example, light-emitting diode 220 preferably shines a red light at lensing system 204, however, any suitable color shield may be used to change the color of the light being emitted by light-emitting diode 220.

Figure 4:
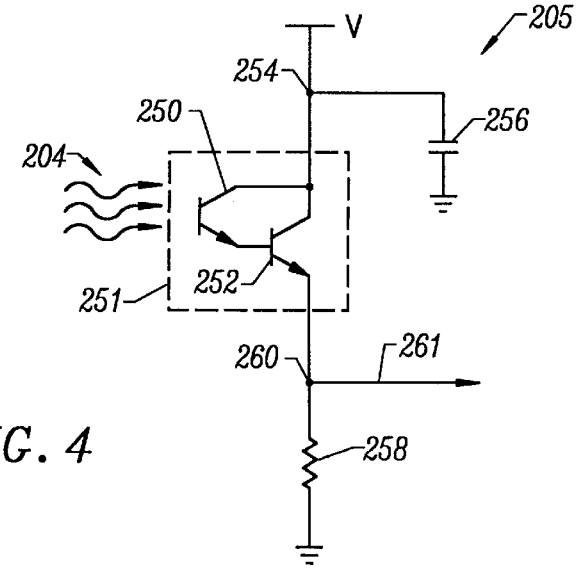
FIG. 4 shows receiver circuitry in accordance with one embodiment of the present invention.

FIG. 4 shows receiver circuitry 205 in accordance with one embodiment of the present invention. As described above, when a player bets a credit, 5 volts will preferably be applied to a node 254 that is connected to a decoupling capacitor 256 used to filter noise. Advantageously, when excess noise is filtered, receiver circuitry 205 maintains a cleaner power supply that enables more accurate detection of triggering disturbances. As shown, the columnated light output from lensing system 204 is directed at a photo transistor 250 that receives the light energy at its base (i.e., producing its base current). Photo transistor 250 then outputs a low current signal through its emitter that is passed to a base of a current amplifier transistor 252. The collector of current amplifier transistor 252 is coupled to node 254 that is also electrically coupled to the collector of phototransistor 250.

In a preferred embodiment, phototransistor 250 and current amplifier transistor 252 define a Darlington-Pair 251 that is suited to generate an amplified current signal to a node 260. Node 260 is then connected to a bias resistor 258. In this embodiment, bias resistor 258 preferably assists in converting the current output from Darlington-Pair 251 into a suitable voltage of about 4 volts at node 260. It should be understood that the voltage produced at node 260 may vary depending upon suitable adjustments to the values of bias resistor 258, Darlington-Pair 251, and the lensing system 204. In a preferred embodiment, node 260 is coupled to a cable 261 that leads to decision circuitry 206.

Figure 5:
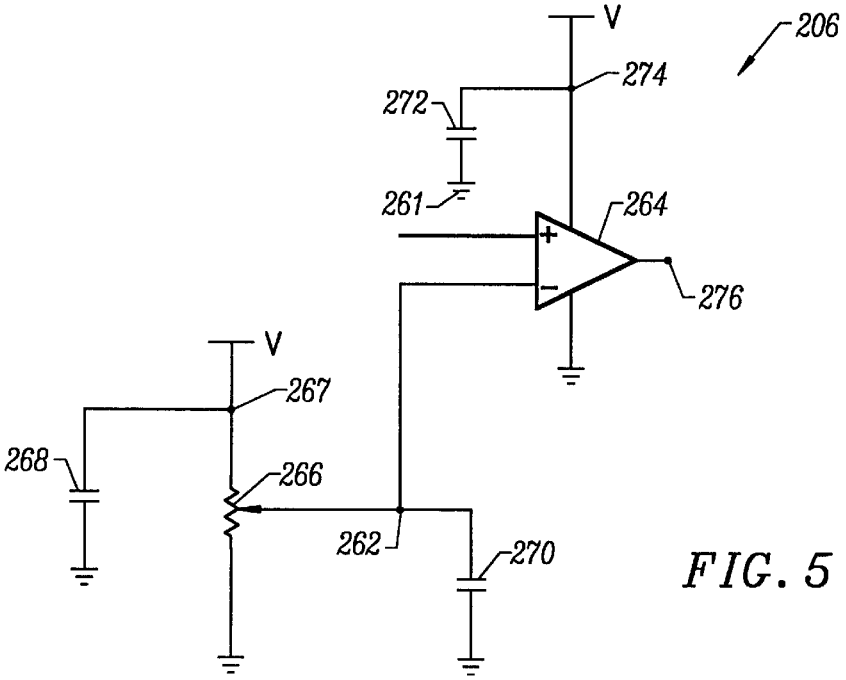
FIG. 5 shows decision circuitry in accordance with one embodiment of the present invention.

FIG. 5 shows decision circuitry 206 in accordance with one embodiment of the present invention. As described above, cable 261 is coupled to node 260 that may be placed at about 4 volts when light-emitting diode 220 of FIG. 3 is providing direct uninterrupted light at phototransistor 250 of FIG. 4. This uninterrupted state should be understood to be an "active state" before the player interrupts the continuous light beam (i.e., after a player bets a credit). Therefore, about 4 volts is applied to a comparator 264 at its non-inverting input through cable 261. Comparator 264 is also provided with a biasing voltage of about 5 volts that is passed through a node 274. In this embodiment, node 274 is connected to a decoupling capacitor 272. Although decoupling capacitor 272 is preferred for providing stable biasing voltages to comparator 264, decoupling capacitor 272 may be omitted in alternative, more compact embodiments.

Comparator 264 is further shown coupled to ground and having an output coupled to a node 276. Connected to the inverting input terminal of comparator 264, is a node 262. Node 262 is in turn, connected between a decoupling capacitor 270 and a variable resistor 266 (i.e., potentiometer). As described above, a voltage level of about 5 volts is provided at a node 267 that is also connected to a decoupling capacitor 268. Although it is believed that decision circuitry 206 works well with decoupling capacitors 270 and 268, alternatively, more compact embodiments may exclude decoupling capacitors 270 and 268.

In operation, variable resistor 266 functions to set the appropriate trigger level of comparator 264. By way of example, when 5 volts is applied at node 267, variable resistor 266 may be adjusted to bring the voltage level of node 262 to about 2 volts. The 2 volts at node 262 is then passed to the inverting input terminal of comparator 264. Accordingly, while light is being generated by light-emitting diode 220 of FIG. 3 and being detected by phototransistor 250 of FIG. 4, comparator 264 is receiving about 4 volts at its non-inverting input terminal and about 2 volts at its inverting input terminal. As such, comparator 264 will maintain an output of about 5 volts (i.e., HIGH STATE).

When the player interrupts the light being emitted from transmitter circuitry 202, the voltage level on cable 261 will preferably drop below (or rise above) about 2 volts to ensure that comparator 264 switches from HIGH to LOW at a node 276. Accordingly, comparator 264 will remain at a HIGH level while the input to its non-inverting input terminal is at least higher than the input at the inverting input terminal. Hence, when the voltage level input into the non-inverting input terminal drops below the voltage level input at the inverting terminal, comparator 264 will transition from HIGH to LOW.

Figure 6:
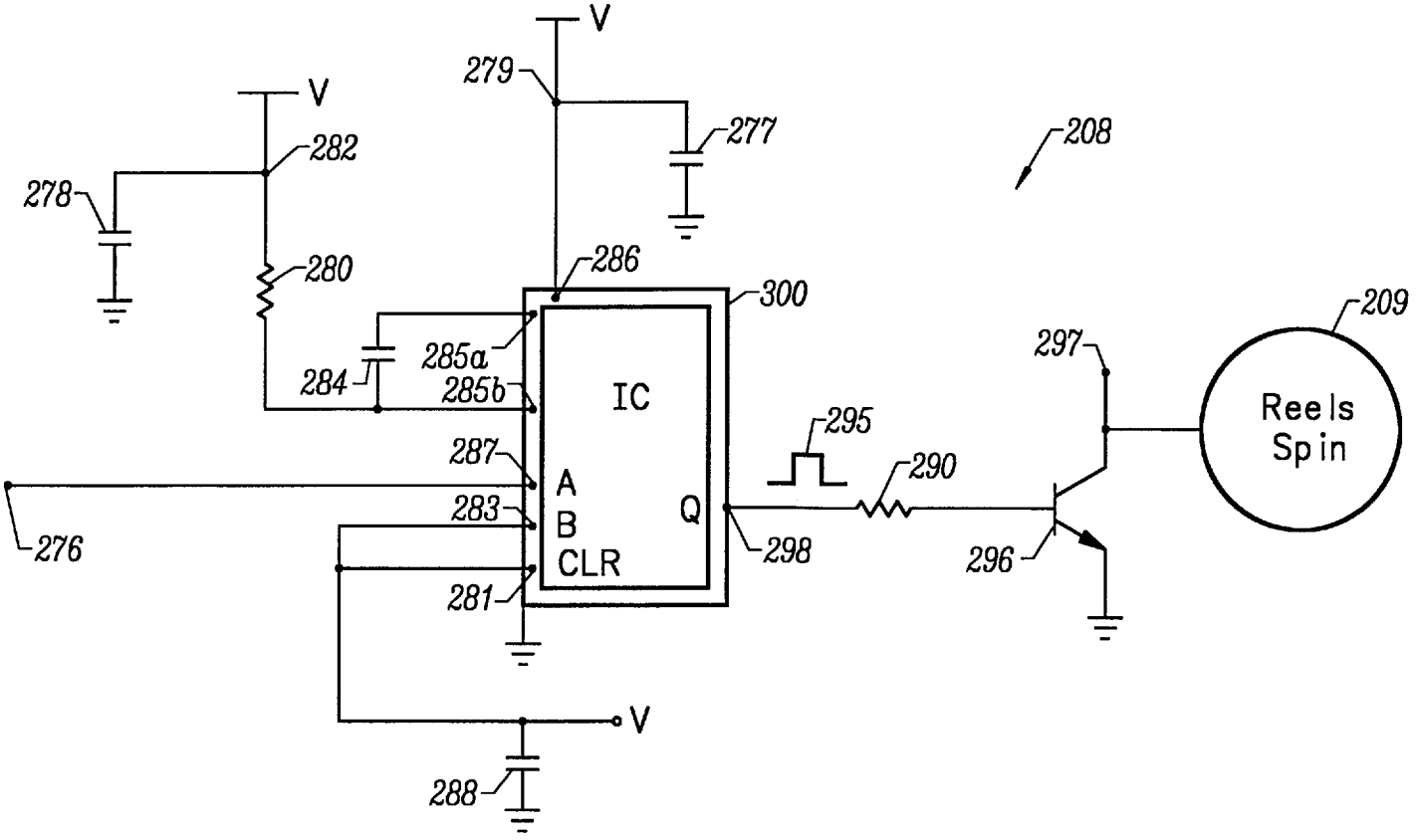
FIG. 6 shows signal conditioning circuitry in accordance with one embodiment of the present invention.

FIG. 6 shows signal conditioning circuitry 208 in accordance with one embodiment of the present invention. Once 5 volts is applied to the biasing line after the player bets a credit, a node 282 will be provided with about 5 volts that is connected to a decoupling capacitor 278. Current is then passed through a resistor 280 that leads to a pin **285*b* that is connected to an integrated circuit (IC) 300. In this embodiment, IC 300** is preferably a re-triggerable one-shot integrated circuit that receives a narrow pulse and outputs a wider pulse that is adjustable at its output. Although any suitable IC logic gate capable of receiving a narrow input pulses and outputting adjustable wider pulse at the output may be implemented, a 74HC221 logic gate manufactured by National Semiconductor of Santa Clara, Calif., is preferably implemented.

Current output through resistor 280 is also passed through a capacitor 284 which is preferably charged-up within a predetermined time and provided as an input to IC 300 through a pin **285*a*. In general, resistor 280 and capacitor 284 may be varied in size to adjust the width of an output pulse 295 generated at output Q 298. By way of example, as approximately 5 volts are applied at node 282, and passed through resistor 280, capacitor 284 begins to charge-up to a level that dictates the width of output pulse 295 at Q 298**.

Therefore, if capacitor 284 charges-up at a faster rate, the width of output pulse 295 will be narrower, and conversely, if capacitor 284 takes a longer time to charge-up, the width of output pulse 295 at Q 298 will be wider. Also shown is a power supply at node 279 that is connected to a cecoupling capacitor 277. Node 279 is then input into IC 300 at a pin 286 to appropriately power up the integrated circuit device. Also connected to IC 300 is a clear (CLR) pin 281 that is connected to a voltage source passed through a decoupling capacitor 288. The voltage source is also passed to a pin (B) 283. In general, the voltage source provided into pins 281 and 283 are generally applied at an initial state refresh the integrated circuit just before a new credit is played.

In operation, when node 276 that is connected to a pin (A) 287 transitions from a HIGH level to a LOW level, IC 300 will produce output pulse 295 at Q 298 having a width dictated by the appropriate settings of resistor 280 and capacitor 284 as described above. Once output pulse 295 is output at Q 298, the pulse is provided to a base of a transistor 296. Preferably, output pulse 295 is first passed through a current limiting resistor 290 to prevent damage to transistor 296. Further, transistor 296 preferably has its collector coupled to suitable pull-up circuitry and its emitter defining an output of signal conditioning circuit 208. In this embodiment, the collector of transistor 296 preferably operates as a switch that triggers reels 113 to spin 209 as described with reference to FIG. 2.

Although the foregoing invention has been described in some detail for purposes of clarity of understanding, it will be apparent that certain changes and modifications may be practiced within the scope of the appended claims. In addition, it should be understood that the various circuit diagrams may be embodied in any form which may include, for example, any suitable semiconductor substrate, printed circuit board, packaged integrated circuit, or software implementation. Accordingly, the present embodiments are to be considered as illustrative and not restrictive, and the invention is not to be limited to the details given herein, but may be modified within the scope and equivalents of the appended claims.

What is claimed is:

1. A gaming machine actuation device, comprising:

a transmitter for emitting light for indicating an active state of the gaming machine;

a lensing system for receiving the emitted light from the transmitter to produce a light column that is output as a concentrated light beam, the lensing system includes a first planar convex lens and a second planar convex lens that are substantially contained within translucent containers and the first planar convex lens is substantially aligned with the second planar convex lens;

a receiver for receiving the concentrated light beam output from the lensing system, the receiver being configured to produce a first voltage level when the gaming machine is in the active state; and a decision circuit configured to accept the first voltage level from the receiver, and a second voltage level from a variable voltage generator, and when the light column is interrupted, the first voltage level drops below the second voltage level that causes the gaming machine to actuate.

2. A gaming machine actuation device as recited in claim 1, wherein the decision circuit outputs a first pulse when the first voltage level is caused to drop below the second voltage level.

3. A gaming machine actuation device as recited in claim 1, further comprising a signal conditioner configured to receive a first pulse and widen the first pulse to produce a second pulse that causes the actuation of the gaming machine.

4. A gaming machine actuation device as recited in claim 3, wherein the signal conditioner includes an integrated circuit having pulse width control inputs.

5. A gaming machine actuation device as recited in claim 1, wherein the transmitter further comprises a light emitting diode directed at the lensing system.

6. A gaming machine actuation device as recited in claim 1, wherein a convex surface of the first and the second planar convex lenses have convex surfaces directed at each other to produce the light column.

7. A gaming machine actuation device as recited in claim 7, wherein the first and the second planar convex lenses that are contained within the translucent containers contain incandescent light bulbs that cause the translucent containers to glow when said gaming machine is in the active state.

8. A gaming machine actuation device as recited in claim 6, wherein the light column is a colored light that is visually apparent.

9. A gaming machine actuation device as recited in claim 1, wherein the receiver includes photo-detector for detecting changes in the light columns intensity.

10. A gaming machine actuation device as recited in claim 9, wherein the photo-detector is included in a darlington-pair integrated circuit.

11. A gaming machine actuation device as recited in claim 10, wherein the darlington-pair outputs a current that produces the first voltage level.

12. A gaming machine actuation device as recited in claim 11, wherein the first voltage level when the gaming machine is in the active state is about 4 volts.

13. A gaming machine actuation device as recited in claim 1, wherein the decision circuit includes a comparator for comparing the voltage levels of the first voltage level and the second voltage level.

14. A gaming machine actuation device as recited in claim 13, wherein the second voltage level is maintained at about 2 volts.

15. A gaming machine actuation device as recited in claim 3, wherein the signal conditioner includes an adjusting resistor and capacitor that are varied in size to modify the width of the second pulse.

16. A gaming machine actuation device as recited in claim 15, wherein the signal conditioner includes an integrated circuit that is configured to receive the first pulse at an input pin, and current from a pair of pins coupled to the adjusting resistor and capacitor.

17. A gaming machine actuation device as recited in claim 1, wherein a plurality of reels are caused to spin when the gaming machine is actuated.

18. A gaming machine actuation device as recited in claim 1, wherein a digital display indicates a wagering result when the gaming machine is actuated.

19. A gaming machine actuation device as recited in claim 1, wherein the variable voltage generator includes a variable resistor.

20. A gaming machine having a light actuation system, comprising:

a transmitter including a first planar convex lens that is substantially contained in a first translucent container, the transmitter is configured to emit a laser light beam indicating an active state of a slot machine, the laser light beam producing a visible light column;

a receiver including a second planar convex lens that is substantially contained in a second translucent container, the receiver is configured to receive the laser light beam that is output from the transmitter, the receiver being configured to produce a first voltage level and cause a glow in the first translucent container and the second translucent container when the gaming machine is in the active state; and a decision circuit configured to accept the first voltage level from the receiver, and a second voltage level from a variable voltage generator, and when the visible light column is interrupted by passing an object through the visible light column, the first voltage level is caused to drop below the second voltage level that causes the actuation of the slot machine.

21. A gaming machine having a light actuation system as recited in claim 20, wherein a first pulse is output from the decision circuit when the first voltage level is caused to drop below the second voltage level.

22. A gaming machine having a light actuation system as recited in claim 20, further comprising a signal conditioner configured to receive a first pulse and widen the first pulse to produce a second pulse.

23. A gaming machine having a light actuation system as recited in claim 22, wherein the signal conditioner includes an integrated circuit configured having pulse width control inputs.

24. A gaming machine having a light actuation system as recited in claim 23, wherein a resistor and capacitor circuit is connected to the pulse width control inputs.

25. A gaming machine having a light actuation system as recited in claim 24, wherein the integrated circuit outputs a triggering signal configured to activate reels contained within a slot machine.

26. A method for activating a gaming machine, comprising:

generating a visible light column at a light generating end when the gaming machine is in a ready state for wagering;

causing a glow in a first translucent container that is part of the light generating end and a second translucent container that is part of a light intensity receiving end;

receiving the visible light column at the light intensity receiving end, the light intensity receiving end being configured to monitor disturbances along the visible light column; and activating the gaming machine when the light intensity received at the light intensity receiving end is altered from a predetermined level while in the ready state.

27. A method for activating a gaming machine as recited in claim 26, wherein the activating of the gaming machine occurs when an opaque object is passed through a path defined by the visible light column.

28. A method for activating a gaming machine as recited in claim 27, wherein when the opaque object is passed through the path defined by the visible light column a reel system is caused to spin.

29. A method for activating a gaming machine as recited in claim 27, wherein when the opaque object is passed along the path defined by the visible light column a digital display is caused to change states.

30. A game actuation system, comprising:

a gaming machine having a housing;

a light activation system having a light transmitter and a light receiver, the light transmitter directs a light beam towards the light receiver;

wherein the light transmitter includes a first translucent container and a second translucent container, the first and second containers are configured to glow when the light transmitter directs the light beam towards the light receiver, and wherein the light receiver determines whether the light beam has been interrupted, whereby when the light receiver determines that the light beam has been interrupted, the light activation system activates the gaming machine.

31. A game actuation system as recited in claim 30, wherein the light beam is interrupted by a user of the gaming machine.

32. A game actuation system as recited in claim 30, wherein the light beam is a visible light beam.

33. A game actuation system as recited in claim 30, wherein the transmitter and the receiver are both positioned on the housing of the gaming machine, the transmitter and the receiver are aligned in a first direction, but separated by a predetermined distance.

34. A game actuation system as recited in claim 30, wherein the transmitter and the receiver are vertically positioned.

* * * * *